US005885175A

United States Patent [19]

Marquez

[11] Patent Number: 5,885,175

[45] Date of Patent: Mar. 23, 1999

[54] TENNIS SERVE/STROKE TRAINING AND EXERCISE APPARATUS

[76] Inventor: Humberto Al Marquez, 1486 Midfield Ave., San Jose, Calif. 95122

[21] Appl. No.: 777,748

[22] Filed: Dec. 21, 1996

[51] Int. Cl.[6] ..... A63B 61/00

[52] U.S. Cl. ..... 473/464

[58] Field of Search ..... 473/215, 205, 473/208, 219, 223, 226, 229, 450, 424, 425, 558, 564, 277

[56] References Cited

U.S. PATENT DOCUMENTS

| | | | |
|---|---|---|---|
| 650,656 | 5/1900 | Raabe | 473/215 |
| 2,103,502 | 12/1937 | Webster | 473/215 |
| 3,937,465 | 2/1976 | Roland | 473/229 |
| 4,030,732 | 6/1977 | Vincent | 473/229 |
| 4,662,640 | 5/1987 | Grander | 473/215 |
| 4,687,209 | 8/1987 | Carey | 473/424 |
| 4,895,373 | 1/1990 | Richmon | 473/215 |
| 5,149,099 | 9/1992 | Radakovich | 473/215 |
| 5,188,365 | 2/1993 | Picard | 473/215 |
| 5,221,089 | 6/1993 | Barrett | 473/215 |

*Primary Examiner*—Theatrice Brown
*Attorney, Agent, or Firm*—John J. Leavitt

[57] ABSTRACT

A tennis serve/stroke training and exercise apparatus. constituting a belt to be worn about the waist. The belt has attached thereto at a point on the belt portion extending across the back one end of an elongated elastic tether. The opposite end of the tether is connected to a handle adapted to be grasped in the hand by the person using the apparatus. The tether is of such length that grasping the handle in the hand while the belt is donned places the handle above one shoulder. For a right-handed person, the handle will be brought into position above the right shoulder, while the tether will extend diagonally across the wearer's back from near the left side thereof. Thus, with the handle in the hand, when the arm is straightened, or swung forwardly as is done when a tennis ball is served, the muscles involved in this motion are tensioned and exercised.

9 Claims, 4 Drawing Sheets

TENNIS SERVE/STROKE TRAINING AND EXERCISE APPARATUS

BACKGOUND OF THE INVENTION

1. Field of the Invention

This invention relates broadly to the sport of tennis, and particularly to an apparatus for improving the serving and other strokes of a tennis player, and for exercising the muscles that are required to effect controlled strokes in terms of power, direction and accuracy of placement of the tennis ball.

2. Description of the Prior Art

A preliminary patentability and novelty seach has not been conducted in connection with the invention disclosed and claimed herein, and the inventor hereof is unaware of the existence of any patents or other published material relating to the subject matter of this invention.

In modern times, with modern equipment, i.e., tennis rackets manufactured from very strong and light composite materials such as graphite and boron, and enabling particularly a more powerful serving stroke, but also enhancing the energy in other strokes, it appears that tennis matches are frequently won by the velocity with which the tennis ball is served from one tennis player to the other. Velocities exceeding one hundred miles per hour have been recorded and are no longer unusual. To achieve that level of velocity of a tennis ball requires that the tennis player be in exceptionally fine physical condition, and that the muscles of the body which are most directly utilized to effectively serve a tennis ball with that velocity, be excercised and fine-tuned to a high degree.

Accordingly, it is one of the important objects of the present invention to provide an apparatus for use by a tennis player for training in what the tennis player believes to be the optimum form of serve, or other stroke, and to enable exercise and to develop the muscles of the body that are most directly utilized to effect such optimum serve or other stroke of a tennis ball.

Some of the muscles that are used most directly to effect a proper or desired serve of a tennis ball, and many other types of strokes, include the muscles of the hand, wrist, the forearm, the upper arm, including the bicepts, sholder muscles, and the back muscles. These muscles are used not only for serving and stroking a tennis ball, but for other purposes relating to many different sports activities. Accordingly, it is another object of the present invention to provide a device for facilitating the exercise of these muscles at times and in localities where it is not normally expected that these muscles could or would be exercised.

Another object is the provision of a tennis serve and stroke training and exercise apparatus that is light in weight, sturdy in its construction, inexpensive to manufacture, and easy to use effectively for the purpose intended.

The invention possesses other objects and features of advantage, some of which, with the foregoing, will be apparent from the following description and the drawings. It is to be understood however that the invention is not limited to the embodiment illustrated and described since it may be embodied in various forms within the scope of the appended claims.

SUMMARY OF THE INVENTION

In terms of broad inclusion, the tennis serve training and exercise apparatus of the invention includes a belt to be worn about the waist. The belt has attached thereto at spaced intervals a plurality of D-rings to any one of which may be attached one end of an elongated elastic tether. The opposite end of the tether is connected to a handle adapted to be grasped in the hand by the person using the apparatus. The tether is of such length that grasping the handle in the hand while the belt is donned, i.e., worn about the waist, requires the hand to be initially positioned adjacent the clavicle or trapesius muscle extending between the shoulder and the side of the neck. Stated in other words, when the device is donned, the tether and handle will be dangling behind the wearer. The wearer reaches behind and grasps the handle and brings it into a position above the shoulder. For a right-handed person, the handle will be brought into position above the right shoulder, while the tether will extend diagonally across the wearers back from near the left side thereof. To achieve this position of the handle, it is necessary that the wearer having arms of normal length reach upwardly and backwardly to grasp the handle, thus elevating the sholder, elbow and hand. Thus, with the handle in the hand, when the arm is straightened, or swung forwardly as is done when a tennis ball is served, exerting even more force and tensioning and stretching the tether, the muscles involved in this motion are tensioned to a greater degree by the requirement to stretch the elastic tether that attaches the handle to the belt. To effect such elastic stretching of the tether will of course also exercise the back muscles, thus exercising the muiscles most directly involved in serving a tennis ball.

BRIEF DEWCRIPTION OF THE DRAWINGS

DESCRIPTION OF THE PREFERRED EMBODIMENT

Figure 1:
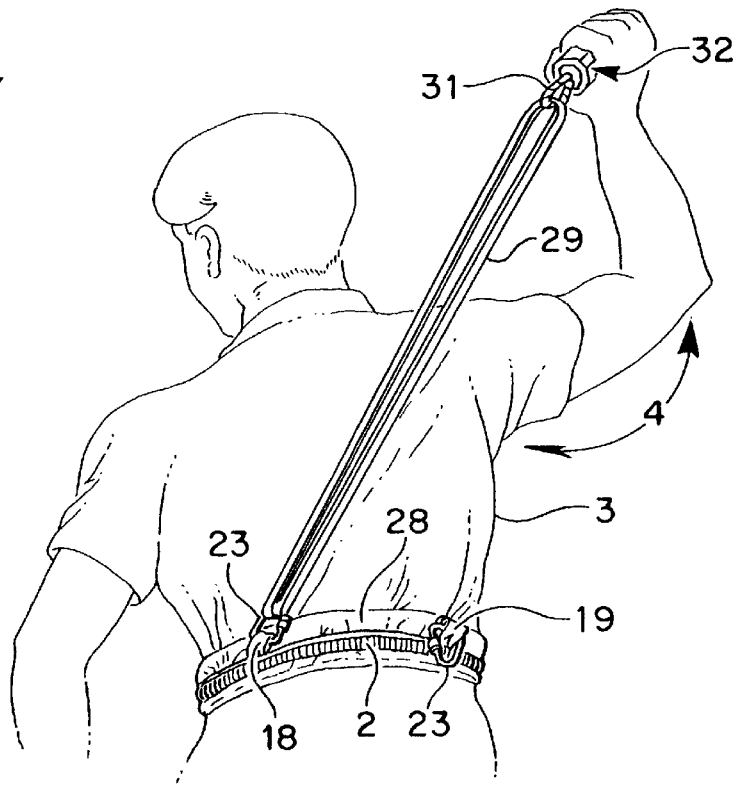
FIG. 1 is a perspective view illustrating the apparatus forming the subject matter of the invention worn by an individual and showing the method of exerting muscular force to stretch the elastic tether.

In terms of greater detail, the tennis serve and exercise apparatus of the invention includes, as one component of the apparatus, a belt designated generally by the numeral 2, and adapted to be worn about the waist of a person 3 for the purpose of anchoring other components of the apparatus selectively manipulable for exercising the arm and shoulder designated generally by the numeral 4, and any other muscles that are involved in the exercise procedure, so as to develop and strengthen the muscles in the hand, wrist, the forearm, the upper arm, including the bicepts, and in the shoulder area, including the trapesius muscle, together with the back muscles.

The belt 2 is preferably formed from web-type material, commonly known as a "web-belt", for strength and non-elasticity, but may be formed from any other suitable material that posseses like characteristics. To connect the belt detachably about the waist of the body of the wearer, there is provided fastener elements 6 and 7 which are adapted to interlock one with the other when pushed toegether, and which may be selectively detached by squeezing the prongs of the element 6 that protrude through the accommodating slots 7' formed in the edge of the fastener element 7 and pulling the two fasteners apart. The fastener element 6 is attached to one end portion 8 of the belt, while the complementary fastener element 7 is connected to the opposite end portion 9 of the belt.

The fastener 6 on the end portion 8 of the belt is of the type that may be adjusted along the length of the belt in order to enlarge or diminish the circumferential girth of the belt when the fasteners 6 and 7 are interengaged.

Sewn to the inner surface 12 of the belt by means of stitching 13 is an elongated cushioning member designated generally by the numeral 14, the cushioning member being formed, for instance, by an elongated tubular sleeve member 14' such as canvas or other woven flexible material within which is encased an appropriate cushioning material such as closed-cell polyurethane foam, as illustrated at 16, or other equivalent synthetic resinous foam-type material. The ends of the elongated flexible sleeve member 14' that contains the cushioning material 16 is sewn together at opposite ends by stitching 17.

Figure 3:
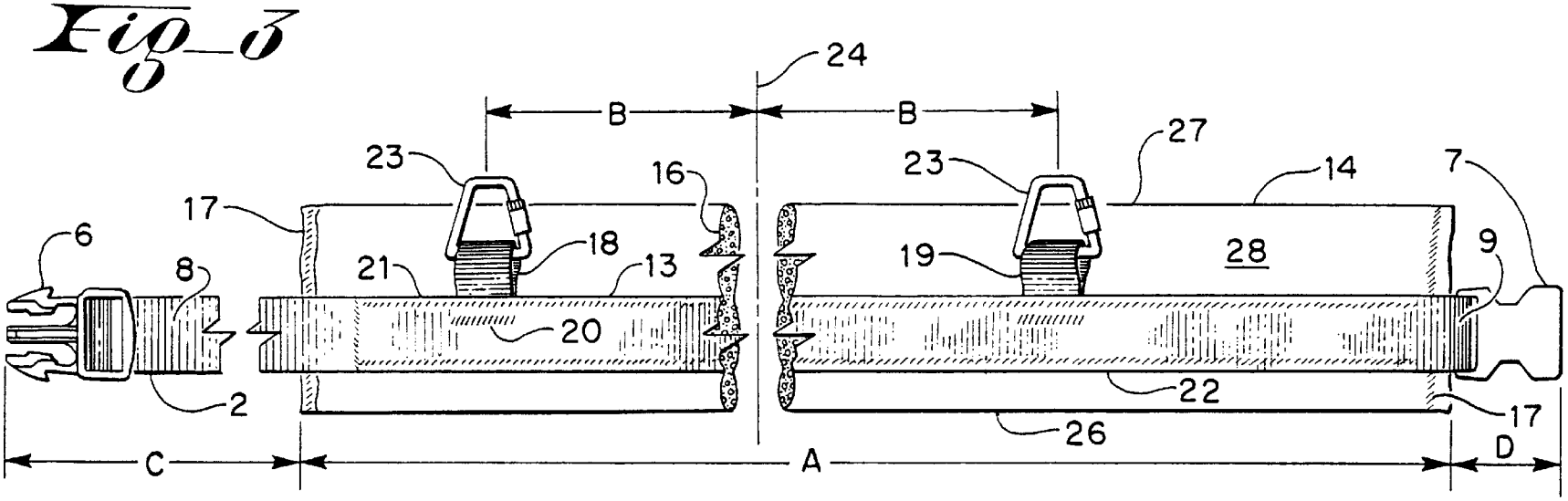
FIG. 3 is an elevational view of the training and exercise apparatus shown in extended form apart from a wearer.
Figure 4:
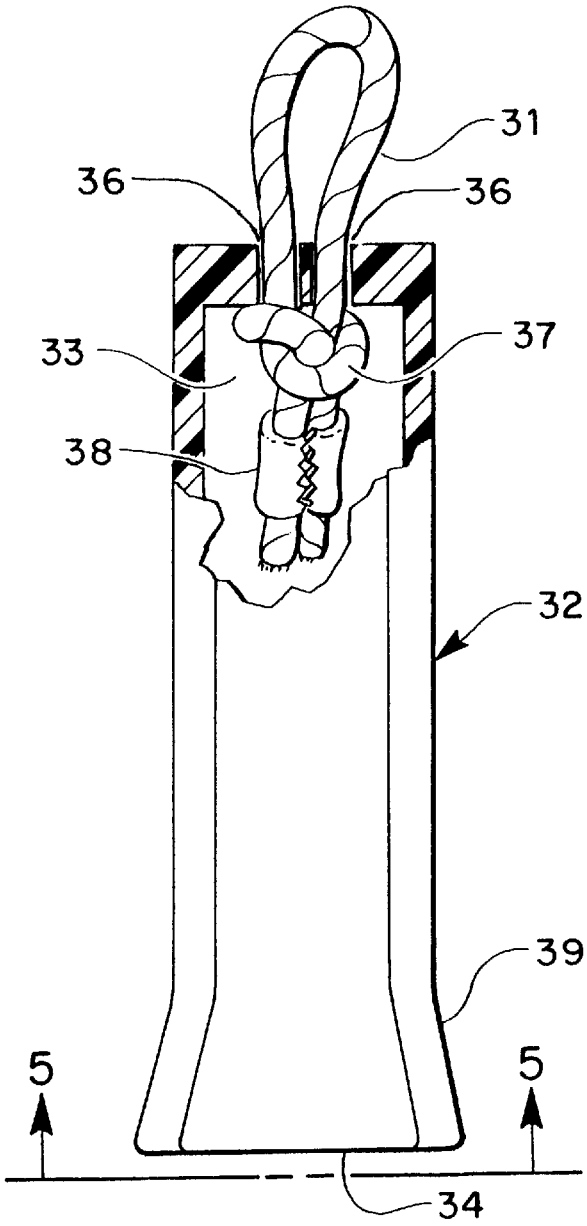
FIG. 4 is an elevational view of the handle structure, a portion of the handle being broken away to illustrate the manner of attachment of the associated end portion of the tether to the handle.
Figure 5:
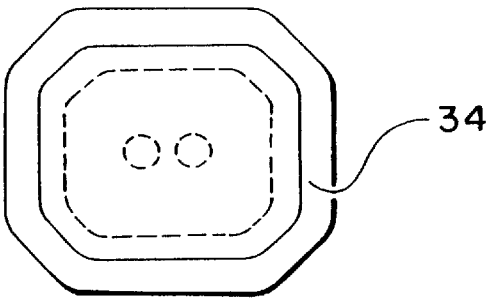
FIG. 5 is an end view of the handle illustrated in FIG. 4, taken in the direction indicated by the arrows 5—5 in FIG. 4.

Referring to FIG. 3, it will be seen that the end of the belt associated with the fastener element 7 is closely adjacent to the end of the belt represented by the stitching 17. This distance, represented by the letter D, constitutes the distance between the stitched end of the flexible sleeve 14 where it is stitched to the belt 2 in comparison to the extreme end of the fastener 7. The overall length of the cushioning member 14, from its stitched end 17 to its opposite end where it is also stitched at 17 in association with the fastener 6, constitutes the major length of the cushioning member 14 which for most people accommodates waist sizes from thirty to about thirty-six. The remaining length of the belt 2 is measured between the end of the stitching 17 adjacent to the fastener element 6, and this distance represented by the letter C, amounts to about eight inches. It should be understood that this distance C is an adjustable distance, that the distance represented by the letter A is a constant distance, as is the distance represented by the letter D. Thus, the adjustability of the size of the belt to fit different sizes of people is accomplished by adjustment of the fastener 6 in relation to the belt 2.

Fastened to the belt 2 at intervals are mounting straps 18 and 19, these mounting straps constituting webbing material similar to the material from which the belt 2 is formed, the straps being folded over upon themselves to form loop openings with the free ends of the mounting straps being stitched to the belt at 20, generally medianly of the transverse dimension of the belt, but probably closer to the top edge 21 of the belt than to the bottom edge 22. Within each of the loops 18 and 19 there is detachably mounted a D-ring 23 for purposes which will hereinafter be explained. The D-rings and anchoring straps 18 and 19 are generally spaced equidistant from the center of the cushioning material 14, the distance that each is spaced from the longitudinal center of the cushioning material being represented by the letter B.

Obviously, the distance represented by the letter B may encompass a range that will be appropriate for different size people. For instance, for a person such as an adult having a thirty-six inch waist, it has been found that the D-rings 23 will be appropriately positioned across the back of the wearer if they are about twelve inches apart, i.e., about six inches on opposite sides of the median line 24 which marks the longitudinal center of the cushioning member, and which will be coincident with the middle of the back of the wearer. In this regard, it is noted that the width dimension of the cushioning member is about two and one-half times wider than the transverse width of the belt 2.

It should also be noted that the cushioning member 14 is not symmetrically placed transversely with respect to the transverse width of the belt 2. Rather, the lower edge 26 of the cushioning member projects below the lower edge 22 of the belt approximately one-half the width of the belt. On the other hand, the upper edge 27 of the cushioning member 14 projects above the top edge 21 of the belt about one and one-half times the width of the belt. This provides a cushioning portion 28 above the top edge 21 of the belt that underlies the anchor straps 18 and 19, and to a large extent also underlies the D-rings 23 to thus provide cushioning material between the back of the wearer and these components that are detachably attached to the belt.

Figure 2:
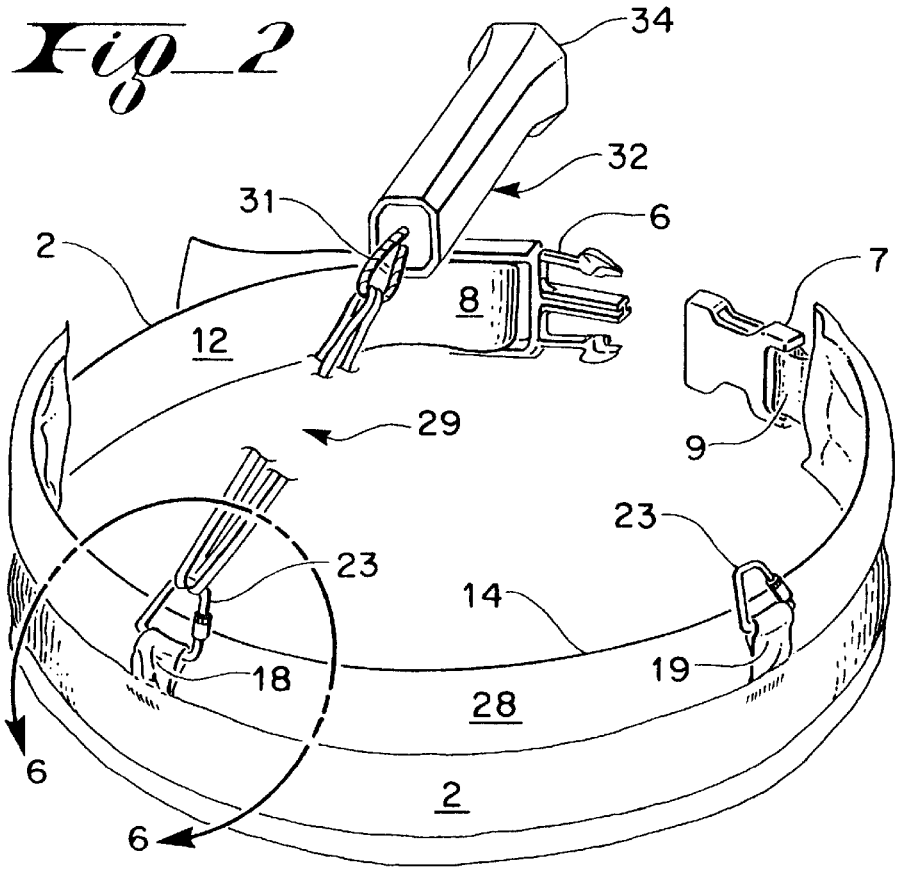
FIG. 2 is a perspective view illustrating the construction of the device, portions of the structure being broken away to reveal underlying structure.

Referring to FIG. 2, it will there be seen that looped through the D-ring 23 is an elongated endless elastic tether designated generally by the numeral 29. The tether also passes through a looped non-elastic retainer cord 31, the opposite ends of which extend into a handle designated generally by the numeral 32, the handle having a hollow interior 33 closed at its end 34 and provided with apertures 36 at its opposite end through which the ends of the retainer cord 31 extend into the hollow interior of the handle. Within the hollow interior of the handle, the retainer cord is provided with a knot 37, and the ends of the retainer cord are bound by a retainer clamp 38 to prevent slippage of the knot. The knot 37 and retainer clamp prevent the retainer cord 31 from being drawn through the apertures 36 when tension is applied to the retainer cord 31 by tension applied to the tether 29. Preferably, to simplify assembly, the knotted and clamped retainer cord 31 is fabricated as a separate article of manufacture. The handle 32 is conveniently injection molded in two complementary halves, the parting line between the two halves being coincident with a plane including the centers of the two apertures 36. The pre-manufactured looped retainer cord 31 is arranged in the recesses (one-half the apertures) formed in one half of the end wall of half the handle, and the other half of the handle is then clamped complementarily thereover and adhesively or otherwise retained thereon to complete the assembly. Obviously, other methods and structures may be utilized to anchor the looped retainer cord 31 to the handle.

It should be noted that the generally octagonal cross-sectional configuration of the handle 32 is confortable to hold in the closed hand of the user, and the free end 39 of the handle is flared outwardly in the same manner that the end of a tennis racket handle is flared so as to provide a slight abutment which the hand of the user may find useful to prevent the hand from slipping off the end of the handle.

Referring to FIG. 2, it is noted that only one tether 29 is illustrated attached to only one of the D-rings 23. In the pattern of attachment shown by way of example in FIG. 2, it is contemplated that the device will be worn by a right-handed person, and utilized to strengthen the muscles associated with the right arm and shoulder of the person. Obviously, for a left-handed tennis player, the tether 29 would be re-positioned and attached to the D-ring 23 which is attached to the anchor strap 19. This would enable the left-handed tennis player to stretch the elongated elastic tether 29 across the back to the left, grasp the handle 32 with the left hand, and thereby exercise the muscles associated with the left arm and shoulder by repeated motion of the left arm and hand.

It should also be understood that while only one tether 29 is shown attached, two such tethers may be attached to the D-rings 23 secured to the anchor straps 18 and 19 so as to enable a person to exercise both arms, shoulders and corresponding back muscles simultaneously. In this regard, the exercise device is not limited to use by a tennis player. Rather, it may be used as a convenient way for anybody to strengthen the muscles of the upper back, shoulders and arms. Additionally, while FIG. 1 illustrates use of the apparatus to strengthen muscles involved in the serving stroke, the apparatus is also useful in strengthening and training muscles used in other tennis strokes, such as the back-hand stroke.

Figure 6:
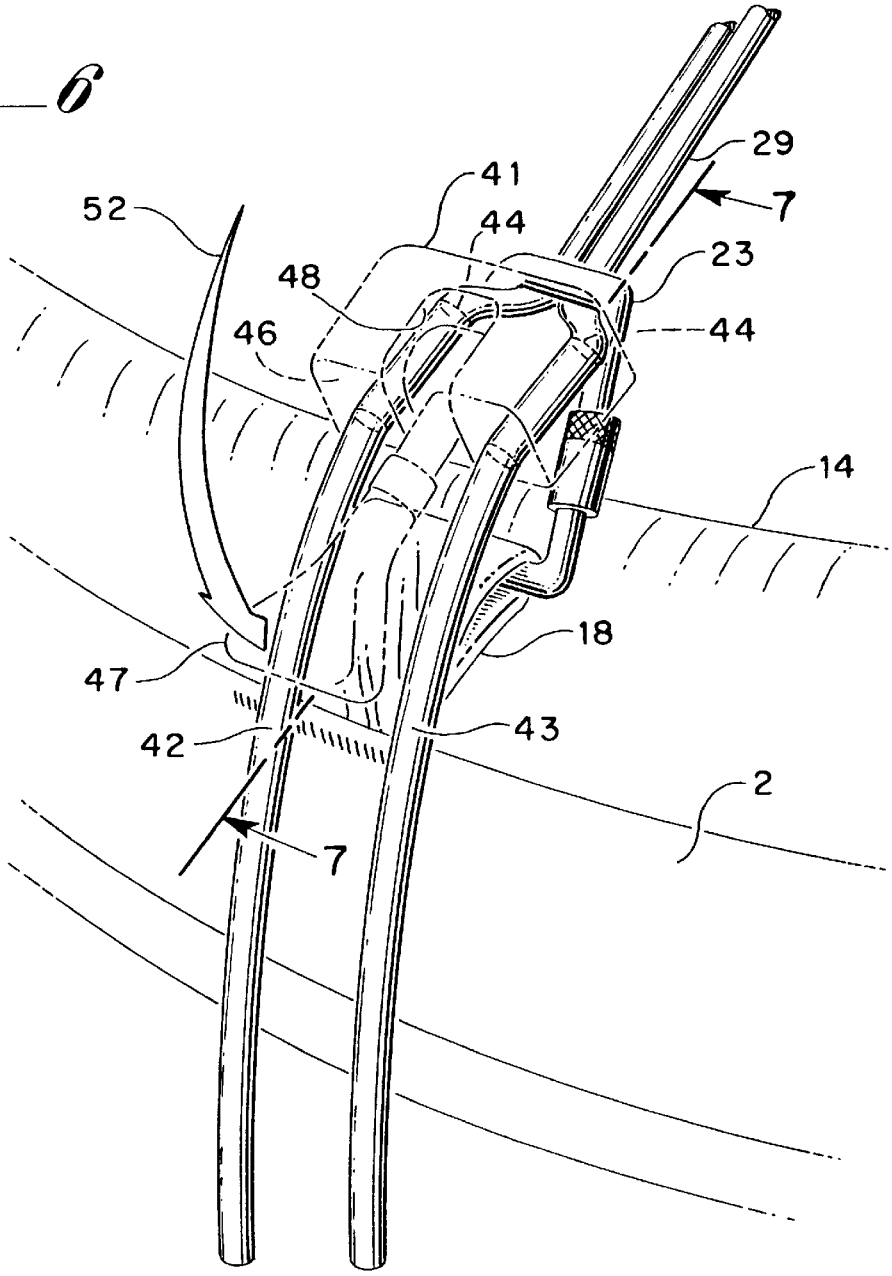
FIG. 6 is an enlarged perespective view of the portion of FIG. 2 indicated by the arrow line 6—6, and illustrating a different method of attachment of the elastic tether to the D-ring on the belt.
Figure 7:
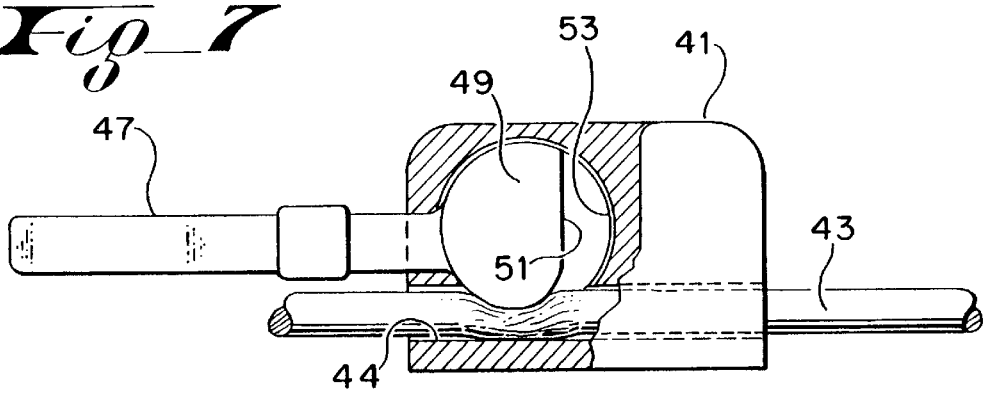
FIG. 7 is an elevational view, partly in vertical section, taken in the plane indicated by the line 7—7 in FIG. 6, and illustrating the mechanism for locking the tether to the belt following adjustment thereof for length.

Referring to FIGS. 6 and 7, there is there shown an alternative structure for attaching an elongated tether 29' to the D-ring 23. In this embodiment, the tether 29' is an elongated elastic member such as a "bungie" cord that has two opposite free end portions 42 and 43 and is not a continuous or endless loop as previously discussed. In this embodiment, there is provided a slide block 41 that is of sufficient width in a transverse dimension to extend across the spaced converging arms of the D-ring 23 as shown in broken lines in FIG. 6. The D-ring is attached to the anchor loop 18 in the usual manner as previously discussed and the opposite free end portions 42 and 43 of the tether 29' extend through parallel bores 44 formed in the block 41. As illustrated, the individual tether portions 42 and 43 of the tether 29' are flexed laterally away from each other as they enter the bores 44 in the block, i.e., diverge, and then extend through the parallel bores and exit out the bottom end of the slide block. Thus, when tension is applied to the tether 29', the block essentially traps the tether members 42 and 43 against slippage in relation to the block 41, and the block 41 abuts against the D-ring 23, thus preventing inadvertent elongation of the relaxed or tensioned tether 29'.

By this attachment structure, th tether may be adjusted for different size people without the necessity of substituting shorter or longer endless tether members, depending upon the size of the person utilizing the apparatus. To insure against such inadvertent elongation of the tether 29', there is pivotally mounted on the block 41 a handle 47 that projects between the free end portions 42 and 43 of the tether. The opposite end of the handle passes through a slot 48 in the block and is attached to a semi-cylindrical member 49 having a flat surface 51 perpendicular to the long dimension of the handle. When the handle is elevated, i.e., pivoted so that it extends perpendicular to the tether end portions 42 and 43, the flat surface 51 lies parallel to the tether cord portions 42 and 43 that lie within the bores 44 and which project into the cylindrical recess normally accommodating the pivotal head 49. When the handle is pulled downwardly in the direction indicated by the arrow 52 to rotate the pivotal head 49, the cylindrical surface 53 of the pivotal head 49 presses against the tether end portions 42 and 43, squeezing them as shown, and thus locking the tether end portions against relative movement in relation to the block 41.

Combining the change in direction of the end portions 42 and 43 as they enter the bores 44 with the squeezing force applied against the tether end portions within the block 41 by the pivot head 49 insures that there will be no inadvertent slippage of the tether in relation to the associated D-ring and therefore no inadvertent elongation or accidental release of the tether when it is tensioned during an exercise procedure.

It will thus be understood that there is provided a very effective tennis serve and tennis stroke training and exercise apparatus that is compact and easily manufactured at low cost, and which is easily stored when not in use. It is believed that through diligent use of this exercise apparatus, the serving stroke of a tennis player may be enhanced over time to enable the tennis player to serve the tennis ball accurately and at very high velocities approachig or exceeding one hundred miles per hour or more.

Having thus described the invention, what is believed to be new and novel and sought to be protected by Letters Patent of the United States is as follows.

I claim:

1. A tennis stroke training and exercise apparatus, comprising:

a) an elongated belt having opposite free ends adapted to encircle the waist when worn by a ten is trainer;

b) means on said free end for adjustably retaining the belt on a tennis trainer;

c) at least two anchor means mounted on the belt spaced from said free ends whereby when said belt is donned by a trainer said anchor means are disposed against the back of a trainer adjacent opposite sides thereof; and d) an having one end elongated elastic tether anchored to at least one of said two anchor means and of sufficient length to extend along the back of a wearer to a free end portion above a shoulder of the a trainer.

2. The training and exercise apparatus according to claim 1, wherein a handle is detachably secured to said free end portion of said elongated elastic tether and adapted to be grasped by the hand of a trainer during use.

3. The training and exercise apparatus according to claim 1, wherein said anchor means mounted on said belt includes a fabric anchor loop attached to said belt.

4. The training and exercise apparatus according to claim 3, wherein said anchor means mounted on said belt includes a D-ring detachably engaging said fabric anchor loop.

5. The training and exercise apparatus according to claim 1, wherein said handle is provided with an octagonal exterior gripping surface.

6. The training and exercise apparatus according to claim 1, wherein said handle is hollow and one end of said handle is flared outwardly.

7. The training and exercise apparatus according to claim 1, wherein a cushioning member is attached to said belt between the trainer back and said anchor means when said belt is donned.

8. The training and exercise device according to claim 1, wherein means are provided for adjustable anchoring said tether to said anchor means whereby the length of said tether between said anchor means and said free end portion may be selectively adjusted.

9. The training and exercise apparatus according to claim 1, wherein said belt is formed from flexible webbing.

* * * * *